US010043428B2

(12) United States Patent
Hemminki et al.

(10) Patent No.: US 10,043,428 B2
(45) Date of Patent: Aug. 7, 2018

(54) EVALUATION OF A DISPLAY TEMPERATURE

(71) Applicant: Microsoft Technology Licensing, LLC, Redmond, WA (US)

(72) Inventors: Toni Hemminki, Tampere (FI); Samu Kallio, Espoo (FI); Tero Maaranen, Tampere (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 93 days.

(21) Appl. No.: 15/164,676

(22) Filed: May 25, 2016

(65) Prior Publication Data

US 2017/0345352 A1 Nov. 30, 2017

(51) Int. Cl.

| | |
|---|---|
| ***G09G 5/02*** | (2006.01) |
| ***G09G 3/00*** | (2006.01) |
| ***G09G 5/06*** | (2006.01) |
| ***G09G 5/10*** | (2006.01) |

(52) U.S. Cl.

CPC ..... *G09G 3/006* (2013.01); *G09G 5/06* (2013.01); *G09G 5/10* (2013.01); *G09G 2330/045* (2013.01); *G09G 2330/12* (2013.01)

(58) Field of Classification Search

CPC ..... G09G 3/006; G09G 5/06; G09G 5/10; G09G 2330/045; G09G 2330/12; G09G 5/02; G09G 2320/0666; G09G 2340/06; G06T 11/001; G01J 5/10; G01J 3/526; G03G 15/2053; G03G 15/2042; H01L 23/34; H01L 27/14645; H04N 5/23212; H04N 5/33; G06K 9/66

See application file for complete search history.

(56) References Cited

U.S. PATENT DOCUMENTS

| | | | |
|---|---|---|---|
| 8,963,845 | B2 | 2/2015 | Alameh et al. |
| 8,988,115 | B2 | 3/2015 | Kim et al. |
| 9,232,135 | B2 | 1/2016 | Kim et al. |
| 2005/0030267 | A1 | 2/2005 | Tanghe et al. |
| 2008/0055209 | A1 | 3/2008 | Cok |
| 2012/0212473 | A1 | 8/2012 | Hasegawa et al. |
| 2012/0253542 | A1 | 10/2012 | Nurmi et al. |

(Continued)

FOREIGN PATENT DOCUMENTS

| | | | |
|---|---|---|---|
| WO | 2013124345 | A1 | 8/2013 |
| WO | 20140084153 | A1 | 6/2014 |

OTHER PUBLICATIONS

"International Search Report and Written Opinion Issued in PCT Application No. PCT/US17/033204", dated Jul 19, 2017, 17 Pages.

(Continued)

*Primary Examiner* — Xilin Guo

(57) ABSTRACT

A temperature of a display is evaluated from the image displayed. The device may be tested with various images or with various test patterns in order to obtain the heat generation response related to the image. For example, a bright image may generate more heat than a dark image. The heat generation response behavior is stored into a device memory. A heat radiation response behavior is also obtained with various test patterns. The display temperature is estimated using an image to be displayed with the predetermined heat generation and heat radiation responses. The ambient temperature may be used to improve the estimation.

20 Claims, 3 Drawing Sheets

(56) References Cited

U.S. PATENT DOCUMENTS

| | | | | |
|---|---|---|---|---|
| 2013/0057808 | A1 | 3/2013 | Mizusako et al. | |
| 2013/0076799 | A1 | 3/2013 | Wurzel et al. | |
| 2013/0091348 | A1* | 4/2013 | Kwon | G06F 1/206 713/100 |
| 2013/0181961 | A1* | 7/2013 | Fujinaka | G09G 3/36 345/207 |
| 2013/0195141 | A1 | 8/2013 | Koudo et al. | |
| 2014/0362889 | A1* | 12/2014 | Jang | G01K 13/00 374/152 |
| 2015/0268100 | A1 | 9/2015 | Ogawa et al. | |
| 2016/0094824 | A1* | 3/2016 | Yang | G06T 5/40 348/243 |

OTHER PUBLICATIONS

Wettach, et al., "A thermal information display for mobile applications", In Proceedings of the 9th international conference on Human computer interaction with mobile devices and services, Sep. 9, 2007, pp. 182-185.

* cited by examiner

EVALUATION OF A DISPLAY TEMPERATURE

BACKGROUND

A display arranged on a device may generate heat, and raise the temperature of the device, the display or radiate it towards the user. As an example, a large portion of a smartphone's surface comprises a display. Other components may generate heat that should be dissipated from the device via the display or the display itself may radiate heat towards sensitive components, thereby potentially risking the functionality. The user may hold the device, such as the smartphone in a manner where the excessive temperature of the device may feel uncomfortable. Temperature sensors are known to measure temperature from the device. The device may respond to excess display heat by reducing the display brightness or by limiting the current fed to the components.

However, some targets of designing a display may be having as low number of components as possible to save manufacturing costs and building the display to be as flat as possible, thereby reducing the number of components.

One existing solution measures the current consumed by the device or a single component. Such current measuring systems may require multiple components consuming the space of the device, which may lead to a bulkier device.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A temperature of a display is evaluated from the image displayed. The device may be tested with various images or with various test patterns in order to obtain the heat generation response related to the image. For example, a bright image may generate more heat than a dark image. The heat generation response behavior may be stored into a device memory as a table, a transfer function or a mathematical formula. A heat radiation response behavior is also obtained with various test patterns.

The display temperature is estimated using an image to be displayed with the predetermined heat generation and heat radiation responses. The ambient temperature may be used to improve the estimation. Image information may also be used, for example, by obtaining histograms of separate colour channels and calculating the intensity of the histograms with a suitable transfer function.

Many of the attendant features will be more readily appreciated as they become better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present embodiments and is not intended to represent the only forms in which the present embodiments may be constructed or utilized. However, the same or equivalent functions and sequences may be accomplished by different embodiments.

Although the present embodiments are described and illustrated herein as being implemented in a smartphone, the device described is provided as an example and not a limitation. As those skilled in the art will appreciate, the present embodiments are suitable for application in a variety of different types of mobile and/or hand-held apparatuses, e.g. in tablets, smart watches, laptops or gaming consoles or larger devices such as televisions. The display temperature estimation may be used in various applications and apparatuses having a display. The display may be a peripheral connected to a system, wherein at least a portion of the user interface is configured to the display.

Figure 1:
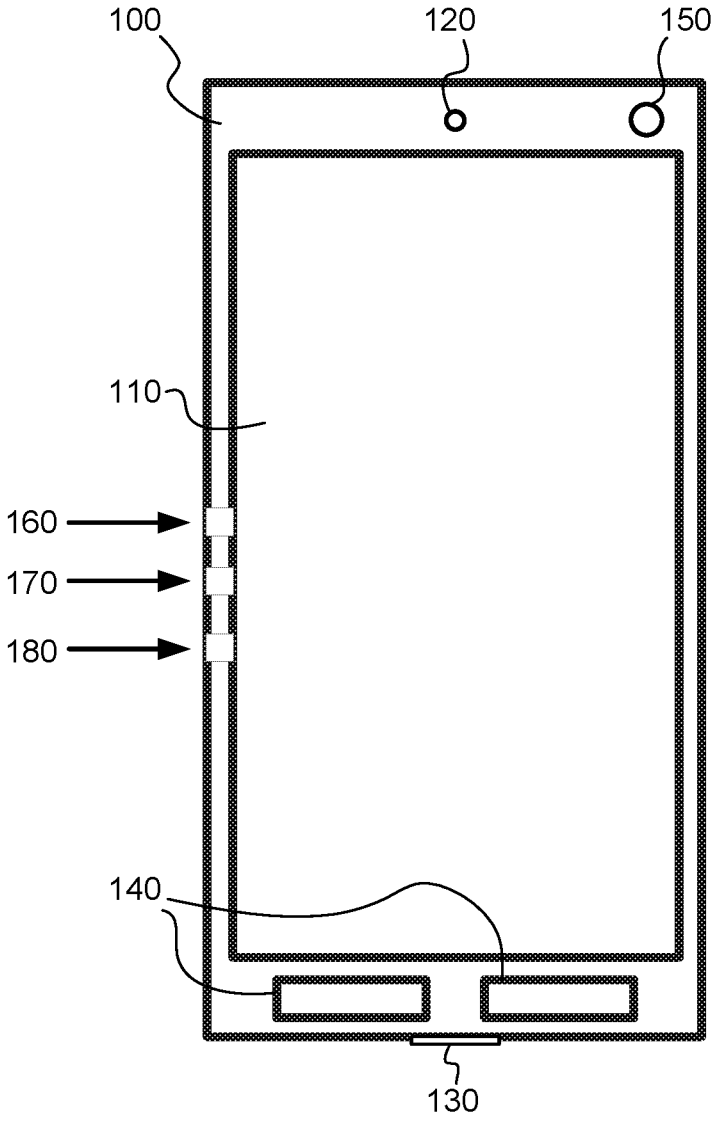
FIG. 1 illustrates a device according to an embodiment.

FIG. 1 illustrates a device according to an embodiment, wherein the device is a smartphone. The device comprises a body 100 comprising a display 110, a speaker 120, a microphone 130, keys 140 and a camera 150. The device comprises at least one processor 160 and at least one memory 170 including computer program code for one or more programs. The at least one memory 170 and the computer program code are configured, with the at least one processor 160, to cause the device to perform at least the functionality described herein. The device comprises display driver element 180 that may comprise features or functions of one or more components. In one embodiment, the display driver element 180 is an integrated chip comprising a memory and a processor. In one embodiment the display driver element 180 comprises the functional chain of components and functions for controlling the display, such as the CPU, the memory or display management circuit or function. The system described hereinafter may comprise a portion of the device, its components and/or peripherals connected to the device.

In one embodiment a heat generation information is created by measuring the heat generation as a response to different test patterns. In one embodiment the heat generation information for the display 110 is determined by displaying a first predefined image on the display 110 and measuring the generated heat as a response to the first predefined image, such as the test pattern. The test pattern may comprise a sequence of predefined images or a single predefined image displayed for a predetermined period of time. The test patterns may comprise different domains that may be used independently or in combination with each other to define the live image response on the display 110. Examples of such domains are different RGB-colour channels; Red, Green and Blue, full white screen, white screen with different brightness, a test pattern image such as black and white chessboard, video patterns such as sweeping colours or a sweeping bar. The measurements are recorded per domain, forming a heat generation information. The heat generation information may be a response function to an image or an image information. The response function may be a multidimensional function. The heat generation may be measured from multiple positions, as the component placement inside the device may cause additional heat loads. That may cause the heat generation response function to be nonlinear. In one embodiment a robot arm may position a temperature sensor configured to measure the temperature from the display surface. The temperature may be positioned from a single position or the temperature may be measured from multiple positions. The heat generation information is stored on the memory 170 as a predetermined heat generation information. In one embodiment the heat generation information is a transfer function of the measured response to the image or the image information, wherein the transfer function is stored on the memory 170 as the predetermined heat generation information. The transfer function is a mathematical representation for fit or to describe inputs and outputs of black box model, wherein the measured response to the image or image information is one embodiment of the black box model. In one embodiment the heat generation information is a mathematical formula of the measured response to the image or the image information, wherein the mathematical formula is stored on the memory 170 as the predetermined heat generation information. In one embodiment different transfer functions or mathematical formulas are stored on the memory, each corresponding to different image domain.

A predetermined heat radiation information may be created by measuring the heat radiation as a response to different test patterns. In one embodiment, a heat radiation information for the display 110 is determined by displaying a second predefined image on the display 110 and measuring the radiated heat as a response to the second predefined image, such as the test pattern. The first predefined image may be the same as the second predefined image. The test patterns may comprise different domains that may be used independently or in combination with each other to define the live image response on the display 110. Examples of such domains are different RGB-colour channels; Red, Green and Blue, full white screen, white screen with different brightness, a test pattern image such as black and white chessboard, video patterns such as sweeping colours or a sweeping bar. The measurements are recorded per domain, forming a heat radiation information. The heat radiation information may be a response function to an image or an image information. The response function may be a multidimensional function. The display 110 may comprise glass, plastic or any other transparent and/or durable material. The heat radiation characteristics may differ in different conditions, such as in different ambient temperatures, causing the transfer function to be nonlinear. The heat radiation information is stored on the memory 170 as a predetermined heat radiation information.

In one embodiment the heat generation information is created by a test device having a thermal sensor configured to measure the temperature of the display 110. The test device may comprise a recurrent neural network system or other artificial neural network suitable for recognizing a pattern. The measured temperature is compared to the displayed image or test pattern. In one embodiment the relationship between the image and the generated heat is modelled as a function of time. In one embodiment the test image, the test pattern or video stream is displayed while operating the device for a period of time. The measurement period may be minutes or several hours. In an embodiment where the device is a smartphone, the various applications may be used as a part of a test pattern. The detected heat generation response from the recurrent neural network system may be stored on the memory 170 as the predefined heat generation information. In one embodiment the predefined heat generation information is stored on the memory during the device manufacturing. The manufactured devices may be deemed similar for the purpose of estimating the display temperature.

In one embodiment the display driver element 180 receives an image to be displayed from the device. In one embodiment the image is received from the operating system. The image may be part of a video stream. The image has a response according to which it may generate heat. The display driver element 180 determines the heat generation using the image or the image information and the predetermined heat generation information. In one embodiment the image information comprises a histogram of the image, illustrating a tonal distribution of the image. In one embodiment the image information comprises a gamma function of the histogram, illustrating an image intensity distribution.

Figure 2:
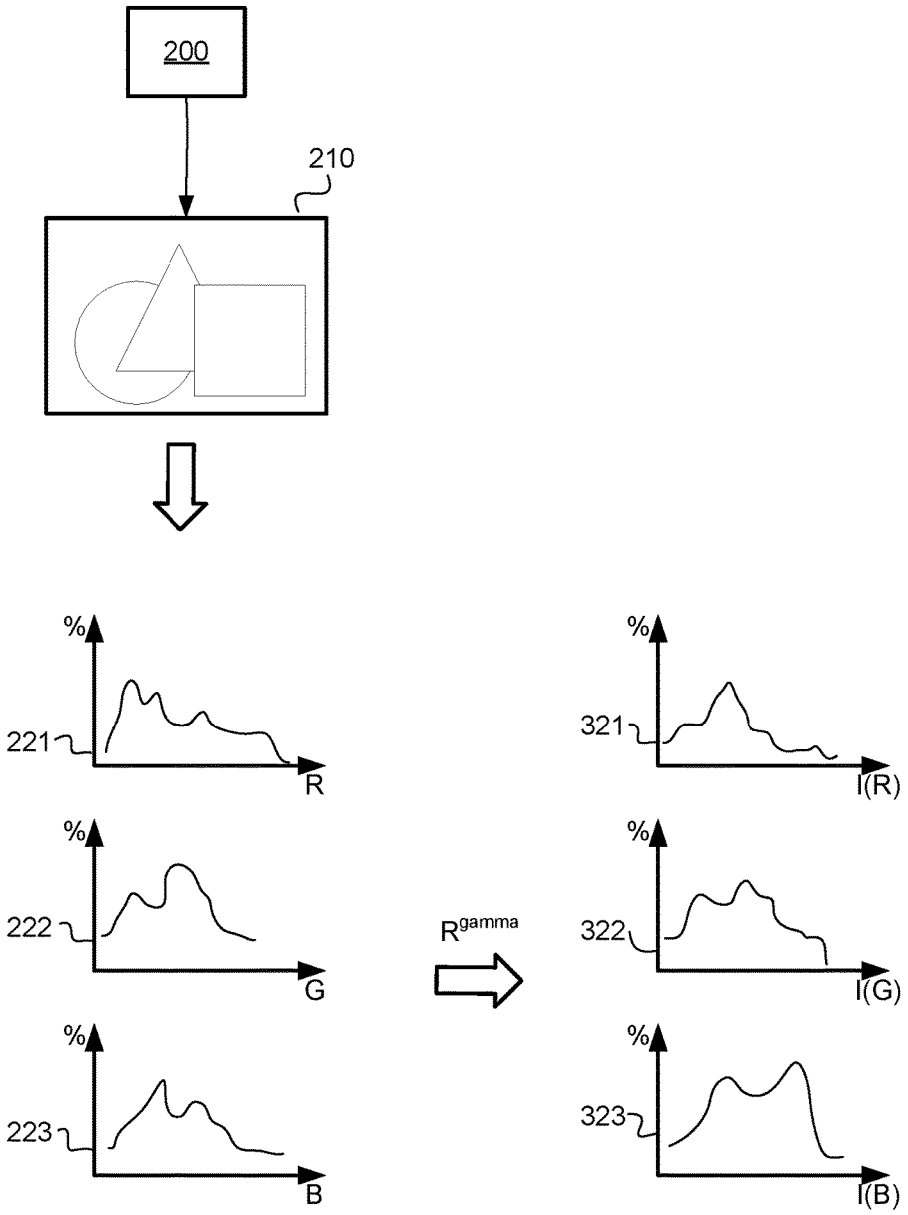
FIG. 2 schematically illustrates one embodiment, of the image information workflow.

FIG. 2 schematically shows an embodiment of the image information workflow. The operating system 200 sends image information to the display driver element 180 of one image frame 210. The display 110 may refresh the image according to a used application. The image information comprises R-, G-, and B-channel histograms 221, 222, 223 of a colour image. The gamma functions 321, 322, and 323 of the histograms illustrate the image intensity that results the heat generation based on the image information. In this embodiment the image generated heat information from the R-, G-, and B-channels is combined into single value and calculated with the predetermined image information, resulting to the heat generation of the whole display 110. The predetermined image information may comprise the display brightness value or other heat response information that has been obtained with test patterns. In one embodiment the workflow is assigned to a portion of the image, resulting to an estimate of a portion of the display 110.

The display driver 180 determines the heat radiation based on ambient temperature and the predetermined heat radiation information. The ambient temperature may be received from a temperature sensor that is configured to another component on the device, for example the CPU may comprise a temperature sensor. The effect of the ambient temperature outside the device body may be included in the measured ambient temperature from inside the device body. In one embodiment, the display brightness value contributes to the ambient temperature information. The effect of the ambient temperature information is calculated according to a measured response model stored as the predetermined heat radiation information.

The display driver 180 determines the temperature of at least one portion of the display based on the difference between the heat generation and the heat radiation. In one embodiment, the one portion of the display comprises the whole display. In one embodiment, the one portion of the display comprises at least one pixel. In one embodiment, the one portion of the display comprises at least one RGB colour channel. The temperature may be estimated at a predefined area of the display. In some areas of the display the image may be more static and brighter than the surrounding area, for example at a software button area configured to respond to a user touch, when the display 110 is a touch sensitive display. Different areas of the display may have significant differences in their thermal behavior, for example due to static displays or proximity to other components that emit heat.

Figure 3:
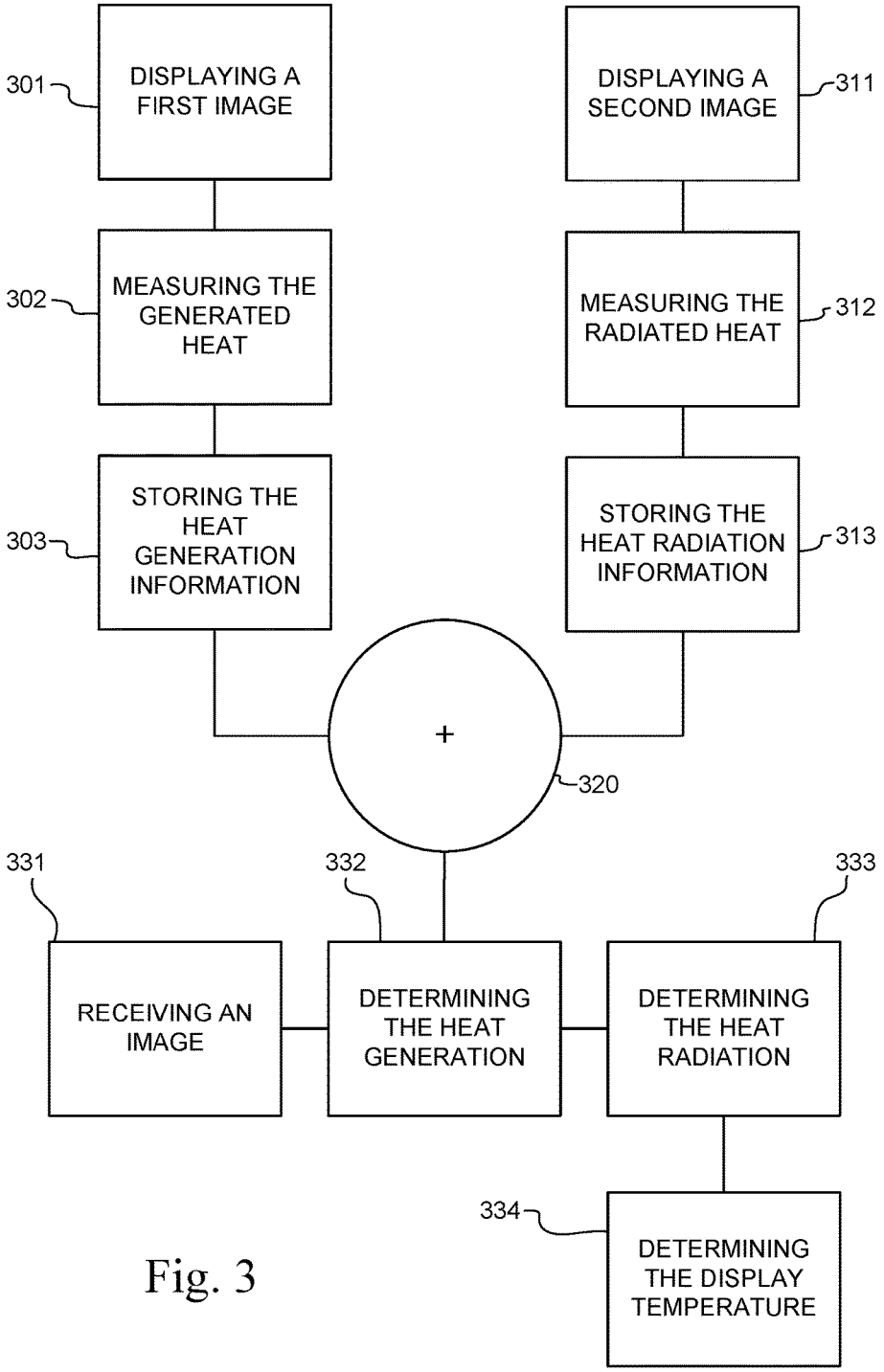
FIG. 3 schematically illustrates a method flowchart.

FIG. 3 shows one simplified flowchart of a method, with the device having a display comprising step 301: determining a heat generation information for the display by displaying a first predefined image on the display and step 302: measuring the generated heat as a response to the first predefined image. Step 311 comprises determining a heat radiation information for the display by displaying a second predefined image on the display and step 312 measuring the radiated heat as a response to the second predefined image. Step 303 comprises storing the determined heat generation information and step 313 comprises storing the determined heat radiation information in a memory of the device. Steps 301-313 may be taken during the manufacturing stage, wherein test images are presented on the device display and information is gathered with test probes. In step 320 the determined information is stored on the device to be used during the operation.

When the device is used, the temperature estimation may be used accordingly. The device comprises the display driver element, comprising the processor and the memory storing instructions that, when executed, control the operation of the device to following method steps. Step 331 comprises receiving an image to be displayed from the device. The image may be any image received from the operating system and processed in the display driver. The image may be a video, a still image or part of a user interface. Step 332 comprises determining a heat generation based, at least in part, on the image and the predetermined heat generation information. Step 333 comprises determining a heat radiation based, at least in part, on ambient temperature and the predetermined heat radiation information. Step 334 comprises determining a temperature of at least one portion of the display based on, at least in part, the difference between the heat generation and the heat radiation.

The present embodiments may enable display temperature measurement without a dedicated display temperature sensor. The present embodiments also allows using the dedicated display temperature sensors, for example to measure temperature differences in the display. The device may be smaller, while other temperature sensors already implemented in other components may also be used to estimate the display temperature information. The display may be thinner as it does not comprise a dedicated temperature sensor—enabling a thinner device, for example in devices where the display determines a large portion of the device thickness, such as in smartphones or tablets.

One aspect discloses a device comprising: a display driver element, comprising a processor and a memory storing instructions that, when executed, control the operation of the device; the memory containing a predetermined heat generation information of a display and a predetermined heat radiation information of the display, wherein the display driver element is configured to: determine a heat generation based, at least in part, on an image information and the predetermined heat generation information, determine a heat radiation based, at least in part, on ambient temperature and the predetermined heat radiation information, and determine a temperature of at least one portion of a display based on, at least in part, a difference between the heat generation and the heat radiation. In one embodiment, the image information comprises histogram of the image. In one embodiment, the image information comprises a gamma function of the histogram. In one embodiment, the display driver element is configured to determine the ambient temperature information based, at least in part, on a display brightness value. In one embodiment, the one portion of the display comprises the whole display. In one embodiment, the one portion of the display comprises at least one pixel of the display. In one embodiment, the one portion of the display comprises at least one colour channel selected from the group of red, green and blue.

Alternatively or in addition, one aspect discloses a system, comprising: a display, a display driver element, comprising a processor and a memory storing instructions that, when executed, control the operation of the device; the memory containing a predetermined heat generation information and a predetermined heat radiation information, wherein the display driver element is configured to: receive an image to be displayed from the device, determine a heat generation based, at least in part, on the image and the predetermined heat generation information, determine a heat radiation based, at least in part, on ambient temperature and the predetermined heat radiation information, and determine a temperature of at least one portion of the display based on, at least in part, a difference between the heat generation and the heat radiation. In one embodiment, the display driver element is configured to determine the heat generation from the image based, at least in part, on the histogram of the image. In one embodiment, the display driver element is configured to determine the heat generation from the image based, at least in part, on a gamma function of the histogram. In one embodiment, the display driver element is configured to determine the ambient temperature information based, at least in part, on a display brightness value. In one example the one portion of the display comprises the whole display. In one embodiment, the one portion of the display comprises at least one pixel. In one embodiment, the one portion of the display comprises at least one colour channel selected from the group of red, green and blue.

Alternatively or in addition, one aspect discloses a method, comprising: a device having a display; determining a heat generation information for the display by displaying a first predefined image on the display and measuring the generated heat as a response to the first predefined image; determining a heat radiation information for the display by displaying a second predefined image on the display and measuring the radiated heat as a response to the second predefined image; storing the determined heat generation information and the determined heat radiation information to a memory of the device; the device comprising a display driver element, comprising a processor and the memory storing instructions that, when executed, control the operation of the device to: receiving an image to be displayed from the device, determining a heat generation based, at least in part, on the received image and the predetermined heat generation information, determining a heat radiation based, at least in part, on ambient temperature and the predetermined heat radiation information, and determining a temperature of at least one portion of the display based on, at least in part, a difference between the heat generation and the heat radiation. One embodiment comprises the display driver element determining the heat generation from the image based, at least in part, on the histogram of the image. One embodiment comprises the display driver element determining the heat generation from the image based, at least in part, on a gamma function of the histogram. One embodiment comprises the display driver element determining the ambient temperature information based, at least in part, on a display brightness value. In one embodiment, the one portion of the display comprising the whole display. In one embodiment, the one portion of the display comprising at least one colour channel selected from the group of red, green and blue.

Alternatively, or in addition, the functionality described herein can be performed, at least in part, by one or more hardware logic components. For example, and without limitation, illustrative types of hardware logic components that can be used include Field-programmable Gate Arrays (FP- GAs), Program-specific Integrated Circuits (ASICs), Program-specific Standard Products (ASSPs), System-on-a-chip systems (SOCs), Complex Programmable Logic Devices (CPLDs), Graphics Processing Units (GPUs). For example, some or all of the display driver element functionality may be performed by one or more hardware logic components.

An embodiment, of the apparatus or a system described hereinbefore is a computing-based device comprising one or more processors which may be microprocessors, controllers or any other suitable type of processors for processing computer executable instructions to control the operation of the device in order to control one or more sensors, receive sensor data and use the sensor data. Platform software comprising an operating system or any other suitable platform software may be provided at the computing-based device to enable application software to be executed on the device.

The computer executable instructions may be provided using any computer-readable media that is accessible by computing based device. Computer-readable media may include, for example, computer storage media such as memory and communications media. Computer storage media, such as memory, includes volatile and non-volatile, removable and non-removable media implemented in any method or technology for storage of information such as computer readable instructions, data structures, program modules or other data. Computer storage media includes, but is not limited to, RAM, ROM, EPROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device. In contrast, communication media may embody computer readable instructions, data structures, program modules, or other data in a modulated data signal, such as a carrier wave, or other transport mechanism. As defined herein, computer storage media does not include communication media. Therefore, a computer storage medium should not be interpreted to be a propagating signal per se. Although the computer storage media is shown within the computing-based device it will be appreciated that the storage may be distributed or located remotely and accessed via a network or other communication link, for example by using communication interface.

The computing-based device may comprise an input/output controller arranged to output display information to a display device which may be separate from or integral to the computing-based device. The display information may provide a graphical user interface, for example, to display hand gestures tracked by the device using the sensor input or for other display purposes. The input/output controller is also arranged to receive and process input from one or more devices, such as a user input device (e.g. a mouse, keyboard, camera, microphone or other sensor). In some embodiments, the user input device may detect voice input, user gestures or other user actions and may provide a natural user interface (NUI). This user input may be used to configure the device for a particular user. In an embodiment the display device may also act as the user input device. The input/output controller may also output data to devices other than the display device, e.g. a locally connected printing device.

The term 'computer' or 'computing-based device' is used herein to refer to any device with processing capability such that it can execute instructions. Those skilled in the art will realize that such processing capabilities are incorporated into many different devices and therefore the terms 'computer' and 'computing-based device' each include PCs, servers, mobile telephones (including smart phones), tablet computers, set-top boxes, media players, games consoles, personal digital assistants and many other devices.

The methods described herein may be performed by software in machine readable form on a tangible storage medium e.g. in the form of a computer program comprising computer program code means adapted to perform all the steps of any of the methods described herein when the program is run on a computer and where the computer program may be embodied on a computer readable medium. The software can be suitable for execution on a parallel processor or a serial processor such that the method steps may be carried out in any suitable order, or simultaneously.

This acknowledges that software can be a valuable, separately tradable commodity. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network).

Any range or device value given herein may be extended or altered without losing the effect sought.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

In the above description, some component, device, module, unit, or element "being configured to" operate in a specific manner or to carry out specific operations, or carrying out such operations when in use, refers to that component, device, module, unit, or element comprising, or itself serving as, "means for" operating in that manner or carrying out those operations.

For example the first ferromagnetic element having poles aligned to generate the first magnetic field and being configured to be connected to the device body comprises, or serves as, means for connecting the ferromagnetic element to the device body. As another example, the second magnetic field being configured to interact with the first magnetic field comprises, or serves as, means for the magnetic fields generated by the first ferromagnetic element and the electromagnetic element interacting, wherein the effect of the interacting magnetic fields causes a force between the magnetic element and the ferromagnetic element and subsequently movement in the actuator.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The term 'comprising' is used herein to mean including the method blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A device, comprising:

a display driver element, comprising a processor and a memory storing instructions that, when executed, control the operation of the device, the memory containing predetermined heat generation information of a device display and predetermined heat radiation information of the device display, wherein the heat generation information for the device display is determined by displaying a first predefined image on the device display and measuring the generated heat as a response to the first predefined image, and wherein the heat radiation information for the device display is determined by displaying a second predefined image on the device display and measuring the radiated heat as a response to the second predefined image, wherein the display driver element is configured to:

receive an image to be displayed, determine a heat generation associated with displaying the received image based, at least in part, on image information associate with the received image and the predetermined heat generation information, the image information comprises one or more of the following: a histogram of the image, a gamma function of the histogram, and a display brightness value, determine a heat radiation based associated with displaying the received image based, at least in part, on ambient temperature and the predetermined heat radiation information, and estimate a temperature of at least one portion of the display based on, at least in part, the difference between the determined heat generation and the determined heat radiation.

2. A device according to claim 1, wherein the image information comprises histogram of the image and a gamma function of the histogram.

3. A device according to claim 2, wherein the image information further comprises the display brightness value.

4. A device according to claim 1, wherein the display driver element is configured to determine the ambient temperature information based, at least in part, on the display brightness value.

5. A device according to claim 1, wherein the at least one portion of the display comprises the whole display.

6. A device according to claim 1, wherein the at least one portion of the display comprises at least one pixel of the display.

7. A device according to claim 1, wherein the at least one portion of the display comprises at least one color channel selected from a group of red, green and blue.

8. A system, comprising:

a display, a display driver element, comprising a processor and a memory storing instructions that, when executed, control the operation of the device;

the memory containing a predetermined heat generation information and a predetermined heat radiation information, wherein the heat generation information for the display is determined by displaying a first predefined image on the display and measuring the generated heat as a response to the first predefined image, and wherein the heat radiation information for the display is determined by displaying a second predefined image on the display and measuring the radiated heat as a response to the second predefined image, wherein the display driver element is configured to:

receive an image to be displayed, determine a heat generation associated with displaying the received image based, at least in part, on image information associate with the received image and the predetermined heat generation information, the image information comprises one or more of the following: a histogram of the image, a gamma function of the histogram, and a display brightness value, determine a heat radiation based associated with displaying the received image based, at least in part, on ambient temperature and the predetermined heat radiation information, and estimate a temperature of at least one portion of the display based on, at least in part, the difference between the determined heat generation and the determined heat radiation.

9. A system according to claim 8, wherein the display driver element is configured to determine the heat generation from the image based, at least in part, on the histogram of the image.

10. A system according to claim 9, wherein the display driver element is configured to determine the heat generation from the image based, at least in part, on a gamma function of the histogram.

11. A system according to claim 8, wherein the display driver element is configured to determine the ambient temperature information based, at least in part, on the display brightness value.

12. A system according to claim 8, wherein the at least one portion of the display comprises the whole display.

13. A system according to claim 8, wherein the at least one portion of the display comprises at least one pixel.

14. A system according to claim 8, wherein the at least one portion of the display comprises at least one colour channel selected from a group of red, green and blue.

15. A method, comprising:

a device having a display;

determining a heat generation information for the display by displaying a first predefined image on the display and measuring the generated heat as a response to the first predefined image;

determining a heat radiation information for the display by displaying a second predefined image on the display and measuring the radiated heat as a response to the second predefined image;

storing the determined heat generation information and the determined heat radiation information in a memory of the device;

the device comprising a display driver element, comprising a processor and the memory storing instructions that, when executed, control the operation of the device to:

receiving an image to be displayed from the device, determining a heat generation associated with displaying the received image based, at least in part, on image information associate with the received image and the predetermined heat generation information, the image information comprises one or more of the following: a histogram of the image, a gamma function of the histogram, and a display brightness value, determining a heat radiation based associated with displaying the received image based, at least in part, on ambient temperature and the predetermined heat radiation information, and estimating a temperature of at least one portion of the display based on, at least in part, the difference between the determined heat generation and the determined heat radiation.

16. A method according to claim 15, comprising the display driver element determining the heat generation from the image based, at least in part, on the histogram of the image.

17. A method according to claim 16, comprising the display driver element determining the heat generation from the image based, at least in part, on the gamma function of the histogram.

18. A method according to claim 15, comprising the display driver element determining the ambient temperature information based, at least in part, on the display brightness value.

19. A method according to claim 15, wherein the at least one portion of the display comprises the whole display.

20. A method according to claim 15, wherein the at least one portion of the display comprises at least one color channel selected from a group of red, green and blue.

* * * * *